United States Patent [19]

Varhelyi

[11] 4,254,875

[45] Mar. 10, 1981

[54] MAIL SORTING APPARATUS AND METHOD

[76] Inventor: Emery Varhelyi, 31 Penarth Rd., Bala Cynwyd, Pa. 19004

[21] Appl. No.: 66,169

[22] Filed: Aug. 13, 1979

[51] Int. Cl.[3] ..... B42F 17/00; B61K 1/00

[52] U.S. Cl. ..... 209/547; 209/702; 209/900; 211/10; 312/212

[58] Field of Search ..... 209/3.3, 3.2, 569, 583, 209/584, 702-705, DIG. 900, 547; 312/234, 234.1-234.4; 211/10; 101/2; 312/212, 250, 270, 301, 283, 287; 258/2, 20

[56] References Cited

U.S. PATENT DOCUMENTS

| | | | |
|---|---|---|---|
| 252,154 | 1/1882 | Temple et al. | 312/287 X |
| 852,304 | 4/1907 | Tilley | 211/10 |
| 1,156,337 | 10/1915 | Wood | 209/546 |
| 1,422,800 | 7/1922 | Van Cott et al. | 211/10 |
| 1,643,841 | 9/1927 | Fuller | 211/10 |

*Primary Examiner*—Allen N. Knowles
*Attorney, Agent, or Firm*—Dann, Dorfman, Herrell & Skillman

[57] ABSTRACT

A sorting apparatus and method for sorting mail matter. The apparatus comprises a cabinet including a series of rows of pigeonholes, each pigeonhole having in registry therewith indicia provided on a shiftable support setting forth destination information, as well as related code information, for the mail matter to be placed therein. One indicia-bearing support is provided for each row of pigeonholes, and the indicia are arranged thereon in sets. The full complement of indicia-bearing supports are simultaneously shiftable between multiple given positions corresponding to the number of sets of indicia.

The method is carried out by first positioning the full complement of supports to display a primary set of indicia. The destination of the uncoded mail matter to be sorted is matched with the indicia of the primary set and deposited in the appropriate pigeonhole. The accumulated mail matter is removed from the pigeonholes, and the full complement of supports is shifted to display a selected one of the remaining sets of indicia, each set of which bears a species-genus relationship to one of the indicia of the primary set. Thereafter, the indicia of the primary set generic to the selected secondary set of indicia is identified. The indicia on the mail matter removed from the pigeonhole associated with the identified primary indicia is then matched with the corresponding indicia of the displayed secondary set and deposited in the appropriate pigeonhole. The mail matter may be encoded during sorting.

19 Claims, 9 Drawing Figures

MAIL SORTING APPARATUS AND METHOD

BACKGROUND OF THE INVENTION

The present invention relates to manual mail sorting, and in particular to a mail sorting apparatus and method which simplifies and expedites the sorting of uncoded and non-machinable mail matter.

Mail service in the United States has been greatly facilitated by the use of the Zip code, a five-digit code system for mail sorting, distribution, and delivery which uniquely identifies each post office and delivery unit, and associates each with the sectional center or major office through which its mail is routed for delivery. Notwithstanding the implementation of the Zip code system, the U.S. Postal Service has been unable to achieve the goal of next-day delivery. This failure is due in no small measure to the fact that a substantial portion of the mail handled daily by the Postal Service has either no indication of its Zip code or the wrong Zip code. A Postal Service publication entitled "Comprehensive Statement on Postal Operations" (January 1979), available from the Government Printing Office, indicates that in first class mail alone, from 3 to 5 billion pieces of mail handled annually by the Postal Service bear either no Zip code or the wrong Zip code. Non-machinable mail, i.e., oversized or bulky pieces which cannot be handled by the Postal Service's automated mail sorting equipment, also presents a problem for the Postal Service since presently there is no effective system for expeditiously directing such mail to its ultimate destination. The Postal Service currently handles between about 6 billion to 10 billion pieces of non-machinable mail annually.

Uncoded and non-machinable mail is problematical in that it requires manual sorting, which is time consuming and rather inefficient, as presently practiced. First, a primary sorting is done which results in bundles of mail which must be transported, with a few exceptions, to individual states, to each of about twenty major post offices located in large metropolitan areas, to foreign countries, or to other miscellaneous destinations. Additional sorting is required to complete the job. Often, as many as four sortings must be performed before a piece of mail reaches its ultimate destination. As is often the case, mail will be transported from one sectional center or major post office to another, passing its ultimate destination one or more times en route, before these several sortings are finally completed.

The sorting of uncoded mail also requires the use of Postal Service personnel who have undergone extensive training to become expert sorters, having the ability to assign Zip codes to mail directed to particular destinations. Typically, it takes years to master the destinations and routes of just one state.

Thus, it takes several sortings and the involvement of an expert sorter before uncoded mail can be forwarded to its destination.

A mail sorting system capable of eliminating one or more of the sortings presently required to direct mail to its ultimate destination would represent a marked improvement over the present system. A system which eliminates the need for trained expert sorters for sorting uncoded mail would also be highly desirable. The availability of such a system would make next-day delivery a more realizable goal.

SUMMARY OF THE INVENTION

Accordingly, it is an object of the present invention to provide an efficient and effective apparatus and method for the sorting of uncoded and non-machinable mail matter.

It is also an object of this invention to minimize the number of sortings necessary to direct uncoded and non-machinable mail matter to its ultimate destination.

It is a further object of the present invention to apply the proper code information to uncoded mail matter in an expeditious manner so that further handling thereof may be carried out using automated systems.

Another object of the present invention is to eliminate the involvement of experts in the mail sorting process.

The foregoing objects have been achieved by the mail sorting apparatus and method of the present invention which enables untrained mail sorters to sort uncoded mail matter and apply the proper Zip code information thereto, if need be, in as few as two sortings. The present invention may also be applied with advantage in the sorting of non-machinable mail. The apparatus of the present invention comprises a sorting cabinet for mail matter comprising a base, partition means defining a plurality of pigeonholes which are aligned in a series of rows upon the base, and indicator means associated with each of the rows of pigeonholes, the indicator means comprising multiple sets of indicia means and shiftable support means on which the sets of indicia means are supported. The cabinet additionally includes means for positioning each indicator means adjacent its associated row of pigeonholes, as well as means for simultaneously shifting the indicator means between multiple given positions corresponding in number to the number of sets of indicia means on the indicator means. Each set of indicia means is in registry with the pigeonholes when its associated indicator means is in one of the given positions. The indicia means indicate the mail matter to be placed in the pigeonholes.

The sets of indicia means are composed of a primary ordered set of indicia means and a plurality of secondary ordered sets of indicia means. The number of indicia means in each set is less than or equal to the number of pigeonholes in the cabinet, and each set of indicia means within the secondary sets bears a species-genus relationship to an indicia means of the primary set.

When using the above-described mail sorting cabinet in carrying out the method of the present invention, the indicator means is first positioned to display the primary set of indicia means in registry with the pigeonholes. Then, each piece of uncoded or unmachinable mail matter to be sorted is matched by the destination thereon with the indicia means of the primary set, which comprises destination information, and deposited in the appropriate pigeonhole. Thereafter, the mail which has been thus deposited in the pigeonholes is removed, and each indicator means is shifted simultaneously to display a selected secondary set of indicia means in registry with the pigeonholes. Next, the indicia means of the primary set generic to the selected secondary subset of indicia is identified, and the destination on the mail matter removed from the pigeonhole associated with the identified primary set indicia means is then matched with the corresponding destination information on the indicia means of the displayed secondary set, and that mail matter is deposited in the pigeonhole corresponding to the matched indicia means. In the case of uncoded mail matter, the Zip code information from the matched indicia means of the selected secondary set may be encoded onto a bundle label for the mail matter in the pigeonhole in registry therewith, or on the individual pieces of mail.

The present invention will be described more fully hereinbelow with reference to the accompanying drawings wherein like reference numerals refer to like elements.

Figure 1:
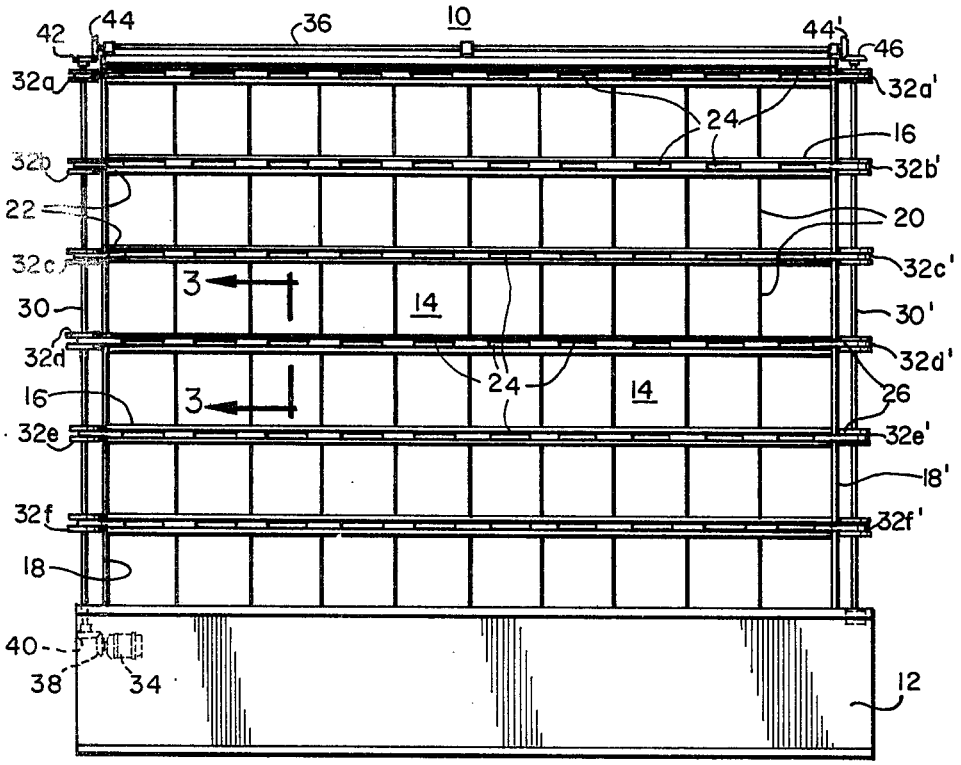
FIG. 1 is a front elevational view of a mail sorting cabinet of the present invention.
Figure 2:
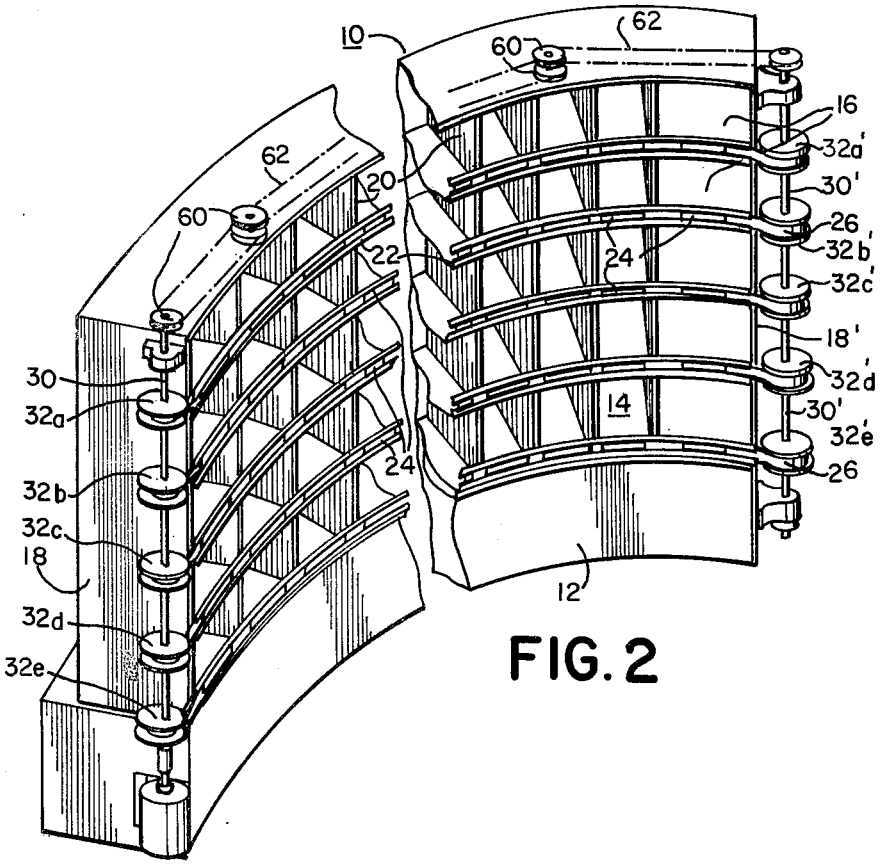
FIG. 2 is a perspective view of another embodiment of the present invention showing a sorting cabinet constructed in arcuate form with the central portion broken away.
Figure 3:
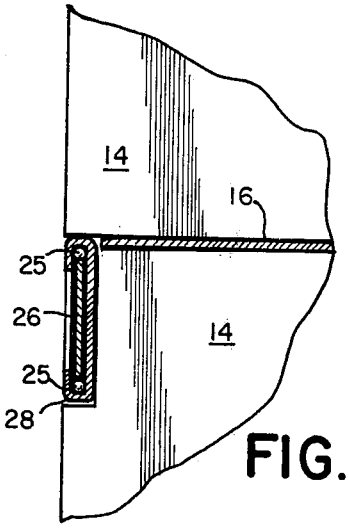
FIG. 3 is a view taken along line 3—3 of FIG. 1 showing guide means for the indicator means.
Figure 4:
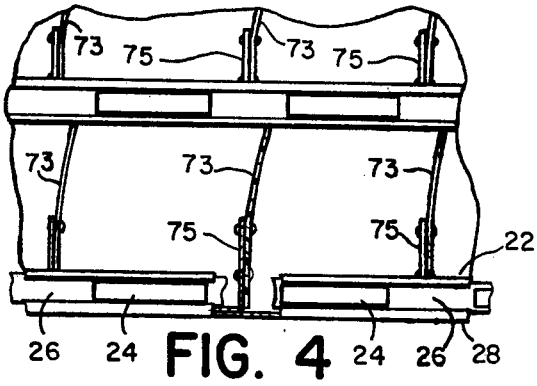
FIG. 4 is an enlarged view of a portion of a row of pigeonholes with indicator means broken away showing a modification of the vertical divider element whereby oversized mail may be accommodated.

Referring specifically to the drawings, FIGS. 1 and 2 show different embodiments of a sorting cabinet according to the present invention generally designated 10. Base 12 supports a plurality of pigeonholes 14 which are arranged in a series of rows thereon. Pigeonholes 14 are formed by a plurality of shelves 16 extending laterally between sidewalls 18 and 18', and a plurality of divider elements 20 extending vertically between the shelves. An indicator means 22 is associated with each row of pigeonholes. As shown in FIG. 4, each indicator means comprises multiple sets of indicia means 24 supported on a shiftable support means 26. As shown in FIG. 1, each set of displayed indicia means is in registry with the pigeonholes. Guide means, such as channel element 28, as shown in FIG. 3, positions each indicator means 22 adjacent its associated row of pigeonholes. Channel element 28 may be provided with means for facilitating the passage of the indicator means therethrough, such as bearings 25 as shown in FIG. 3.

As shown in FIG. 2, base 12 may be formed in the shape of an arc with the shelves in substantial alignment therewith. This arrangement provides a work space for a mail sorter and reduces the distance between the sorter and the pigeonholes, thus making a large number of pigeonholes easily accessible and rendering the overall sorting procedure more efficient.

Cabinet 10 is provided with means for simultaneously shifting the indicator means to display different sets of indicia means 24. As illustrated in FIGS. 1 and 2, the shifting means may comprise a pair of vertical shafts which are rotatably mounted on the exterior of each sidewall of the cabinet 10, and a series of reels 32*a*–*f*, 32*a'*–*f'* fixedly mounted on each shaft, the number of reels on each shaft corresponding to the number of rows of pigeonholes in the cabinet. Each reel is disposed adjacent a shelf. The shafts provide pairs of opposing reels on each side of the cabinet in substantial alignment with the shelves, and an indicator means is reeled on each pair of opposing reels. Reels 32*a*–*f*, 32*a'*–32*f'* thus also function to position the indicator means adjacent its associated row of pigeonholes. Preferably, the support means is a flexible strip means extending along each row of pigeonholes, the pairs of reels serving to position the strip means substantially in the plane of the front openings of the pigeonholes. Rotary motion may be imparted to one of the shafts by an electric motor 34, as shown in FIG. 1, or a crank may be utilized for manual operation. Of course, the motor or crank must be capable of moving the indicator means in either direction. Means for transmitting the rotary motion to the other shaft may be provided in the form of a horizontally disposed rod 36 as shown in FIG. 1, or a series of sprockets 60 and chains 62, the latter being shown schematically in FIG. 2. In the arrangement illustrated in FIG. 1, a beveled pinion 38 mounted on the distal end of the drive shaft of motor 34 imparts rotary motion to shaft 30 through beveled gear-wheel 40. Gear-wheel 42, located on the upper end of shaft 30, transmits the rotary motion to rod 36 through beveled-pinion 44. Beveled-pinion 44', in turn, transmits the rotary motion to the shaft 30' through gear-wheel 46. Thus, when shaft 30, as shown in FIG. 1 is caused to rotate, the full complement of indicator means shifts simultaneously.

In order to accommodate oversized mail matter in the pigeonholes, which will ordinarily measure less than six inches across the opening, divider elements 20 may be constructed with a flexible upper portion 73 and a rigid lower portion portion 75, as shown in FIG. 4. The flexible upper portion permits the oversized mail matter to project into the upper area of an adjacent pigeonhole. The flexible divider elements are preferably slightly longer than the distance between adjacent shelves, as shown in FIG. 4, so that the flexible portion will bend in only one direction. Where flexible divider elements are employed, the column of pigeonholes on the far right of the sorting cabinet must be wider than the rest, as shown in FIG. 2.

Figure 5:
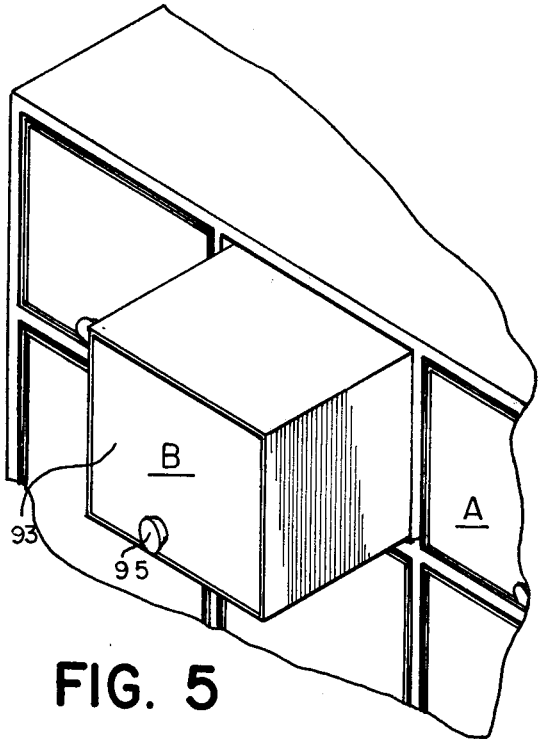
FIG. 5 is a perspective view of the back of the sorting cabinet showing an embodiment of the invention wherein the capacity of the pigeonholes may be expanded.

The capacity of the pigeonholes may be increased by providing each pigeonhole with telescoping container means, as shown in FIG. 5, which is movable between a contracted position (Pigeonhole "A") and an extended position (Pigeonhole "B"). In the contracted position, the capacity of each pigeonhole is equal to the capacity of the container means, whereas in the extended position, the capacity of each pigeonhole is about twice the capacity of the container means. The sorting cabinet may be designed for emptying from the backside, in which case the telescoping container means serves the dual function of expanding the overall capacity of the sorting cabinet, and alerting the personnel responsible for emptying the cabinet that particular pigeonholes are at least half full. To this end, the container means may be provided with a door 93 and handle 95 in the rear thereof as shown in FIG. 5. When the container means is full, it may be pushed slightly toward the back of the sorting cabinet, alerting the aforesaid personnel to extend the container means and/or empty the same.

Although a 60-pigeonhole cabinet is illustrated in FIG. 1, the number of pigeonholes may vary depending upon the volume of mail matter handled at a particular facility.

As previously mentioned, the multiple sets of indicia means 24 provided on support means 26 are composed of a primary ordered set of indicia means and a plurality of secondary ordered sets of indicia means. The primary set will typically include the names of the 50 states, the District of Columbia and territorial possessions of the United States arranged alphabetically. In addition, the primary set of indicia means will also include an alphabetical breakdown of groups of destinations within the state in which the method is in operation, and each such group will be assigned an alphabetic designation. For example, in the main post office in Philadelphia, a portion of the primary set of indicia may appear as follows: " . . . /Oklahoma/Oregon/PA cities AA-BE/ . . . /PA cities X-Z/Puerto Rico/Rhode Island/ . . . ". Groups of destinations in one or more surrounding states, e.g., New Jersey in the present example, may also be included in this breakdown.

The primary set of indicia means may also be divided into categories according to street sections, with each category being assigned an alphabetic designation. Again using Philadelphia as the example, such categories may appear as follows:

"Streets AA-APP/ . . . /Streets Wellington-Z". Also included within the primary set of indicia may be an alphabetical classification of groups of other destinations receiving an unusually high volume of mail daily, such as office buildings. Optionally, the primary indicia means may also include designations for a number of the larger metropolitan areas throughout the country.

Mail destined for states, or large metropolitan areas, for which no breakdown appears in the primary set of indicia, will undergo a primary sorting and be forwarded to one or two sectional centers or a main post office in the designated state.

Each indicia means in the primary set having an alphabetic designation bears a genus-species relationship to each individual set of indicia means within the secondary set of indicia means. For instance, in the foregoing example, "PA cities AA-BE" is the genus of which the cities Aaronsburg through Beyer are species. The same is true of street section categories, "Streets A-APPLE" being the genus of which "A" Street through Appletree Street are species. Thus, each secondary set of indicia contains a series of specific destinations encompassed within the broad designation of its corresponding primary set of indicia. Also, each indicia means of the secondary sets includes Zip code information for the series of destinations included therein. Accordingly, the first listed indicia means of the secondary set corresponding to the primary set of "PA cities AA-BE" will be Aaronsburg 16829.

In preparing to carry out the method of the present invention, a sorting cabinet of the type described hereinabove must be constructed having a predetermined number of pigeonholes. This number will ordinarily correspond to the number of indicia means within the primary set. For example, a sorting cabinet suitable for use in the main post office in Philadelphia may have 7 rows of pigeonholes with 22 pigeonholes per row, i.e., a total of 154 pigeonholes. 57 of these pigeonholes would be allocated to 48 states, the District of Columbia and eight territorial possessions of the United States. Another 28 pigeonholes would be allocated for an alphabetical breakdown of groups of cities within Pennsylvania (20 pigeonholes) and New Jersey (8 pigeonholes). Some 41 pigeonholes would be used to categorize street sections of Philadelphia. The remaining 28 pigeonholes would be for the deposit of mail to specified metropolitan areas, large office buildings, foreign countries, and other miscellaneous destinations.

Although the dimensions of the pigeonholes may vary, each one is preferably about 5 inches×5 inches×13 inches. Using these dimensions, a sorting cabinet having 7 rows of pigeonholes with 22 pigeonholes per row would be approximately 3 feet high and 9 feet wide.

Preparation of the indicator means for a 154 pigeonhole cabinet of the type just described begins by first applying to the support means each indicia means of the primary set in alphabetical order. Thus, the names Alabama through Maine would appear on the topmost indicator means running from left to right; Mariana Islands through New York would appear on the next indicator means; North Carolina through PA cities T-V would appear on the following indicator means, and so on.

Thereafter, the secondary sets of indicia means would be applied to the support means, also in alphabetical order. The first such set would comprise the specific destinations, and related Zip code information, corresponding to the primary set of indicia means designated "N.J. cities A-C"; the tenth such set would comprise the specific destinations and related Zip code information corresponding to the primary set of indicia means designated "PA cities BEY-CAS"; the thirtieth such set would be the street section Ansley Ave.; 19126 through Banes 11600–11799; 19116.

Like the primary set of indicia means, each of the indicia means within any given set of the secondary sets of indicia means are applied in alphabetical order to the indiciator means starting from the left end of the uppermost indicator means and proceeding to the right end of the lowermost indicator means. A sorting cabinet having 154 pigeonholes may have as many as 23,716 individual indicia on the indicator means thereof.

A rather complete sorting for all of the 50 states may be accomplished using an 180 pigeonhole cabinet in which 5 pigeonholes are designated for the mail destined for Alabama, 2 for Alaska, 2 for Arizona, 5 for Arkansas, 11 for California, etc. By using an 180 pigeonhole cabinet, sortings for 32,400 destinations may be accomplished.

Regardless of the number of pigeonholes in the sorting cabinet, the number of destinations which may be accommodated in any one of the pigeonholes associated with the primary set of indicia means and having an alphabetic designation may be no greater than the total number of pigeonholes in the sorting cabinet.

In addition to a specific destination and related Zip code information, each indicia means of the secondary sets of indicia means may have associated therewith code-bearing means carried by the support means, which code-bearing means enables the mail sorter to encode manually a portion of the indicia means onto the mail matter placed in the pigeonholes. In most instances, the portion of the indicia means encoded onto the mail matter will be the Zip code information.

The code-bearing means may take the form of a stencil or an embossed printing plate which is an integral part of the support means. Such code-bearing means may be made self-inking by manufacturing procedures well known in the printing art. Alternatively, the code-bearing means may be detachable from the support means, in which case the encoding step of the method will require detaching the code-bearing means from the support means, and imprinting the code onto the mail matter deposited in the pigeonhole associated therewith. Typically, the detachable code-bearing means will be an embossed printing element which is impressed onto the mail matter after having ink applied thereto from a suitable source, e.g., an ink pad.

Figure 6:
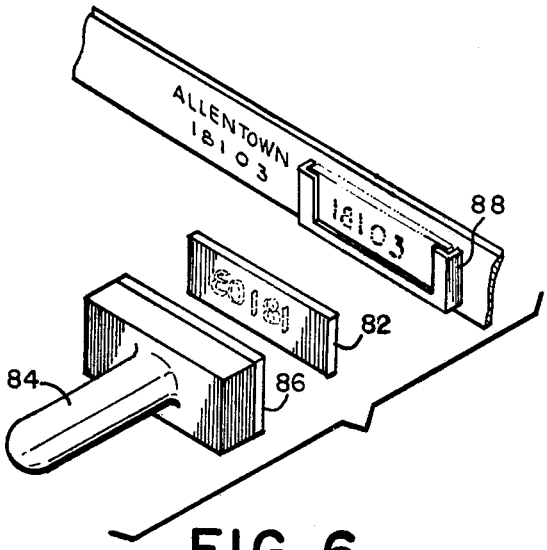
FIG. 6 is an enlarged fragmentary view of an indicator means with detachable code bearing means.

As shown in FIG. 6, a small pocket 88 may be provided on the support means to carry detachable printing element 82. Alternatively, the printing element may be retained between the ends of a spring-loaded wire clip or by a magnet. The surface of the printing element 82 facing the sorter may be made of a metallic material to facilitate detachment of the element from the support means, which may be accomplished by the use of a handle 84 having a portion 86 which is formed from a permanent magnet. Alternatively, portion 86 may be made of an adherent material such as Velcro ® and the printing element provided with a fabric back to which it adheres. The surface of printing element 82 seen by the sorter also bears code information identical to that on the corresponding indicia means, as shown in the phantom representation in FIG. 6, so that the printing elements will not become misplaced.

Regardless of whether the code-bearing means is integral with the support means, or detachable therefrom, it must be sufficiently thin and flexible to be taken up on reels 32*a–f*, 32*a'–*32*f'*, as shown in FIG. 1. When the sorting is completed, the sorter may encode the mail matter from each pigeonhole with the correct Zip code information by using the code-bearing means. If there are numerous pieces of mail in each pigeonhole after sorting, it is unnecessary to print Zip codes on each piece, since a single bundle label will suffice. This procedure dispenses with the pre-printed bundle labels currently in use in sorting mail, and thus avoids printing errors, mislabeling and the like.

The encoding of the mail matter may also be automated.

Figure 7:
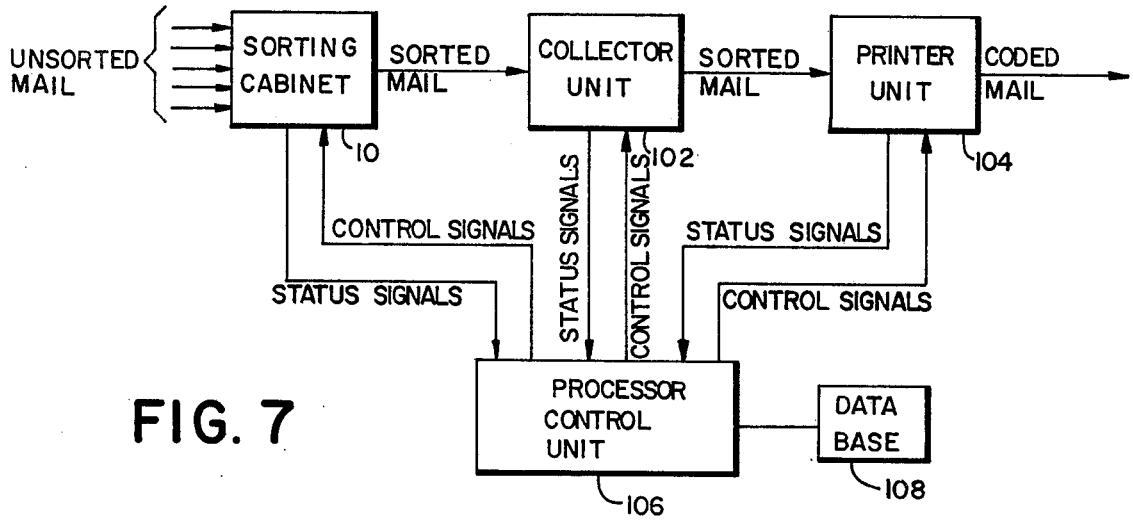
FIGS. 7–9 are block diagrams illustrating alternative automated modes of encoding mail matter which may be used in practicing the present invention.

In one mode of automatic encoding, as shown in FIG. 7, the procedures are subject to processor control, e.g., by a microprocessor or a mini-computer. A data base 108 consisting of a series of pigeonhole locations and their corresponding Zip code information is entered into the processor control unit 106. The series of pigeonhole locations represent the sequence in which the pigeonholes will be emptied. When the encoding procedure is initiated, the control unit "reads" the data base sequentially, transmits a signal to the sorting cabinet 10 which causes the emptying of the appropriate pigeonhole by electro-mechanical means well known to those skilled in the art. After a predetermined period of time for emptying the contents of a pigeonhole into a collector unit 102 has elapsed, or after a sensor in the pigeonhole sends an "empty" signal to the control unit, the control unit then signals collector unit 102 to start feeding the mail matter to a printer unit 104, and simultaneously sends a signal to the printer unit identifying the Zip code which corresponds to the pigeonhole that has just been emptied, and which is to be printed on the mail matter being fed from the collector unit. The collector unit signals the processor control unit when its hopper is empty, and the processor control unit repeats the procedure for each subsequent entry in the data base.

Figure 8:
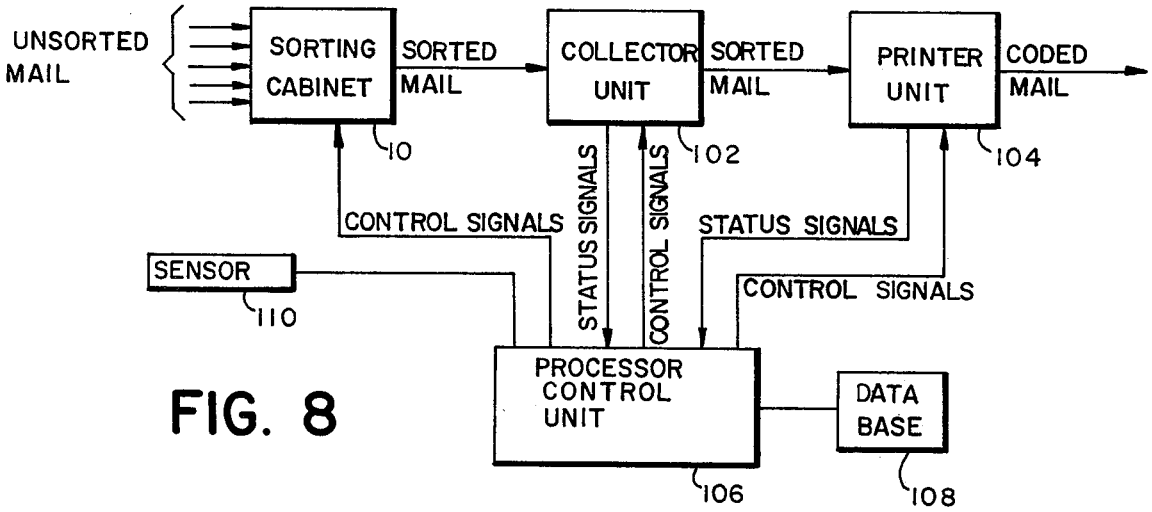

In another automatic coding mode, as illustrated in FIG. 8, a sensor 110 operatively associated with the collector unit 102 "reads" pigeonhole location information from the indicator means, for example. Using the same data base 108 as that described above, the sensor 110 transmits the pigeonhole location to a processor control unit 102 which matches the transmitted information with a pigeonhole location in the data base 108. When a match is made, the processor unit transmits the corresponding Zip code to the printer unit 104, which encodes that Zip code onto the mail matter being fed thereto from the collector unit.

In this mode of operation, it is preferable to employ an optical sensor in which light emitted from the sensor is reflected from the indicator means, thus enabling a photodetector in the sensor to detect pigeonhole location information which may be carried on the indicator means. Instead of an optical sensor, it is possible to use a magnetic device in which a pickup coil in the sensor detects magnetically-coded pigeonhole location information from the indicator means.

Figure 9:
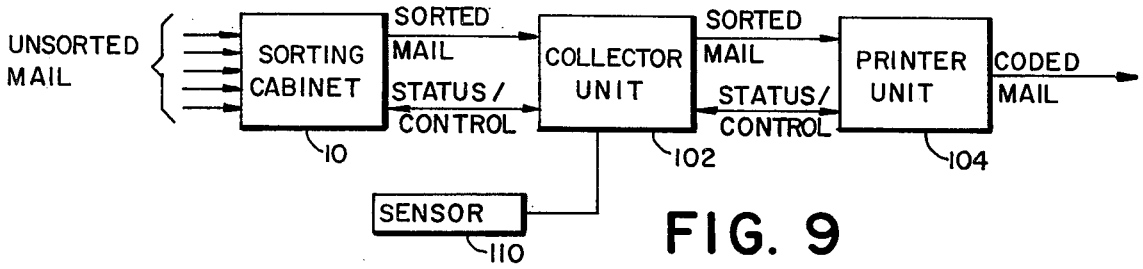

In a third mode of automatic operation, as shown in FIG. 9, the processor control unit may be replaced by integrated circuit devices if the pigeonhole location information is made identical to the corresponding Zip code. In that case, when the encoding procedure is initiated, the sensor 110 "reads" the Zip code directly from a pigeonhole being emptied. The sensor then transmits the Zip code to the printer unit 104. When the hopper of the collector unit 102 is fed the contents of one pigeonhole, it in turn feeds the mail matter to the printer unit. At the same time, the collector unit signals the printer unit to begin printing. After all of the mail matter has been fed to the printer unit, another pigeonhole is emptied and the procedure is continued. In this mode, the "intelligence" of the processor is replaced by electronic logic possessed by the various units.

After the primary set and secondary sets of indicia means are applied to the support means, and a suitable encoding system has been incorporated into the apparatus, each indicator means is wound onto its appropriate reels and the sorting apparatus is then ready for use. The preparation of the indicator means, as described hereinabove, need be done only once for each sorting cabinet.

When uncoded mail is received for sorting, the mail sorter will first display the primary set of indicia means and make a primary sort by matching the destination on the individual pieces of mail with the indicia means of the primary set, and depositing each piece in the pigeonhole in registry with the matched indicia means. Thus, in the aforementioned example using a 154 pigeonhole sorting cabinet, letters for Alabama will be deposited in the pigeonhole labeled "Alabama"; letters for Alaska will be deposited in the pigeonhole labeled "Alaska"; letters for Aaronsburg, PA will be deposited in the pigeonhole labeled "PA cities AA-BEY" and so on. As previously mentioned, mail headed to destinations for which no breakdown appears in the primary set of indicia will undergo a primary sorting only, after which the accumulated mail in each pigeonhole will be bundled for transportation with an appropriate label attached thereto, and then forwarded to a sectional center or main post office at the indicated destination for further sorting.

After the primary sorting has been completed, all of the pigeonholes are emptied of their accumulated mail matter and the indicator means are shifted to display a selected one of the secondary sets of indicia means in registry with the pigeonholes. For instance, the secondary set having indicia means Aaronsburg 16820; Abbottstown 17301; Abington 19001 . . . Beyer 16211 might be displayed. Thereafter, the indicator means of the primary set generic to the selected secondary set is identified along with the mail matter removed from the pigeonhole associated with the identified primary indicia means. In keeping with the present example, the identified primary indicia means would be PA cities AA-BEY. Next, the destination on the identified mail matter is matched with the corresponding indicia means of the displayed secondary set and deposited in the pigeonhole in registry therewith. For example, letters destined for Aaronsburg, PA would be placed in the pigeonhole labeled "Aaronsburg 16820", and so on. After the primary and secondary sortings are completed, the Zip code information from the matched indicia means is encoded onto the mail matter by any of the means described hereinabove. No encoding occurs while the mail matter is being sorted. Since the method of the present invention results in the encoding of the appropriate Zip code on uncoded mail matter, further handling of such mail matter may be carried out using automated systems.

Although the number of times that the indicator means will be changed in sorting a batch of mail generally corresponds to the number of pigeonholes in the cabinet, when a number of sorters are employed in carrying out the method, the number of times that each sorter must change the indicator means is correspondingly reduced.

As can be seen from the foregoing description, the mail sorting apparatus and method of the present invention enables uncoded and non-machinable mail to be dispatched to its ultimate destination after only two sortings in most cases, while avoiding the involvement of expert sorters in the sorting of uncoded mail. In addition, since a great many sortings may be accomplished in one location using one sorting cabinet for sorting mail to thousands of destinations, the present invention greatly reduces the space requirements for sorting mail, as compared with methods presently in use. Also, the present invention significantly minimizes the time that the mail is in transit, since after only two sortings, the mail may be forwarded to its destination or to a sectional center very near to its destination.

Thus, each postal facility at which this method is employed may determine Zip codes, postal routes, etc., and generate bundles of mail for transportation to a great many different destinations, thereby facilitating distribution of the mail.

While a particular embodiment of the present invention has been illustrated and described herein, it is not intended to limit the invention to such disclosure, but changes and/or additions may be made therein and thereto without departing from the invention as set forth in the following claims.

I claim:

1. A sorting cabinet for mail matter comprising a base, partition means defining a plurality of pigeonholes, said pigeonholes being aligned in a series of rows on said base, one indicator means associated with each of said rows of pigeonholes, said indicator means comprising multiple sets of indicia means and shiftable support means on which said sets are supported, guide means positioning said indicator means adjacent its associated row of pigeonholes and means for simultaneously shifting said indicator means between multiple given positions corresponding in number to said sets, said indicia means indicating the mail matter to be placed in said pigeonholes, each set of indicia means being in registry with said pigeonholes when its associated indicator means is in one of said given positions.

2. A sorting cabinet according to claim 1 wherein said base includes sidewalls, and said partition means comprises a plurality of shelves extending laterally between said sidewalls and a plurality of divider elements extending vertically between said shelves.

3. A sorting cabinet according to claim 1 wherein said multiple sets of indicia means comprises a primary ordered set of indicia means and a plurality of secondary ordered sets of indicia means.

4. A sorting cabinet according to claim 3 wherein each indicia means of said secondary sets of indicia means has associated therewith code-bearing means carried by said support means for encoding a portion of said indicia means onto the mail matter placed in said pigeonholes.

5. The sorting cabinet according to claim 4 wherein the code-bearing means comprises a stencil.

6. The sorting cabinet according to claim 4 wherein the code-bearing means comprises an embossed printing plate.

7. A sorting cabinet according to claim 2 wherein said base is arcuate around a center point, providing a workspace for a sorter between said center point and said partition means, and wherein said shelves are in substantial arcuate alignment with said base.

8. A sorting cabinet according to claim 2 wherein said divider elements comprise a lower rigid portion and an upper flexible portion for the accommodation of large size mail matter.

9. A sorting cabinet according to claim 2 wherein each pigeonhole has associated therewith telescoping container means, said container means being movable between a contracted position and an extended position, the capacity of the pigeonholes being equal to the capacity of said container means when said container means is in said contracted position, and the capacity of said pigeonholes being about twice the capacity of said container means when said container means is in the extended position.

10. A sorting cabinet according to claim 2 wherein said support means comprises a flexible strip means extending along each row of said pigeonholes substantially in the plane of the front openings of said pigeonholes.

11. A sorting cabinet according to claim 2 wherein said shifting means comprises a pair of vertical shafts having upper and lower ends, said shafts being rotatably mounted on the exterior of each sidewall of said cabinet, a series of reels fixedly mounted on each shaft, the number of said reels on each shaft corresponding to the number of said rows of pigeonholes, each reel being disposed adjacent a shelf, said shafts thereby providing pairs of opposing reels on each side of said cabinet in substantial alignment with said shelves, one of said flexible strips being reeled on each pair of opposing reels, means for imparting rotary motion to one of said shafts and means for transmitting said rotary motion to the other of said shafts.

12. A sorting cabinet according to claim 11 wherein said one shaft is provided with beveled gear-wheels on its upper and lower ends, said other shaft is provided with a beveled gear-wheel on its upper end, said motion imparting means comprises an electric motor having a horizontally disposed drive shaft and a beveled pinion mounted on the distal end of said drive shaft, said pinion meshing with said lower gear-wheel, and wherein said said motion transmitting means comprises a horizontally disposed rod having beveled pinions mounted on each end thereof, said rod-mounted pinions meshing with said upper gear-wheels.

13. A method for sorting mail matter wherein said mail matter is sorted in a cabinet comprising a base, partition means defining a plurality of rows of a predetermined number of pigeonholes, said pigeonholes being aligned in a series of rows on said base, one indicator means associated with each of said rows of pigeonholes, said indicator means comprising a primary ordered set of indicia means, a plurality of secondary ordered sets of indicia means, and shiftable support means on which said primary and said secondary indicia means are supported, the number of indicia means in said primary set being no greater than the predetermined number of pigeonholes, the number of indicia means in each of said secondary sets being no greater than the predetermined number of pigeonholes, each set of indicia means within said secondary sets being related to an indica means within said primary set in the manner of species to a genus, the indicia means in each of said sets being in registry with said pigeonholes when said indicator means are in a given position, and means for simultaneously shifting said indicator means between given positions, said method comprising the steps of:

(a) positioning said indicator means to display said primary set of indicia means in registry with said pigeonholes;
(b) matching the indicia on said mail matter with the indicia means of said primary set and depositing said mail matter in the pigeonhole in registry with the matched indicia means;
(c) removing the accumulated mail matter from all of said pigeonholes;
(d) shifting said indicator means to display a selected one of said secondary sets of indicia means in registry with said pigeonholes;
(e) thereafter identifying indicia means of the primary set generic to said selected secondary set and the mail matter removed from the pigeonhole associated with said primary indicia means; and
(f) matching the indicia on said identified mail matter with the corresponding indicia means of said displayed secondary set and depositing said identified mail matter in the pigeonhole in registry with the matched indicia means.

14. The method of claim 13 which additionally comprises the step of encoding a portion of said indicia means of said displayed secondary set onto said mail matter deposited in the pigeonhole in registry therewith.

15. The method according to claim 14 wherein each of said secondary sets of indicia means has associated therewith code-bearing means carried by said support means for encoding a portion of said indicia means onto the mail matter to be placed in said pigeonholes and the encoding step includes detaching said code-bearing means from said support means, and imprinting said code onto the mail matter deposited in the pigeonhole associated with said code-bearing means.

16. The method according to claim 14 wherein each of said secondary sets of indicia means has associated therewith code-bearing means carried by said support means for encoding a portion of said indicia means onto the mail matter to be placed in said pigeonholes and the encoding step includes impressing the code-bearing means onto the mail matter deposited in the pigeonhole associated with said code-bearing means to imprint said code onto said mail matter.

17. The method according to claim 14 wherein said encoding step includes providing computer means with data input comprising a predetermined sequence of pigeonhole locations and code information corresponding to each pigeonhole location, said computer means being responsive to said data input and operable to cause removal of mail matter from said pigeonholes in said predetermined sequence and to activate encoding means for encoding onto said mail matter the code information corresponding to the pigeonhole location from which said mail matter was removed, removing said mail matter from said pigeonholes in said predetermined sequence and encoding onto said mail matter said code information.

18. The method according to claim 14 wherein said encoding step comprises providing computer means with data input comprising a sequence of pigeonhole locations and code information corresponding to each pigeonhole location, said computer means being responsive to sensing means for sensing pigeonhole locations to cause the removal of mail matter from a pigeonhole and to activate endoding means for encoding onto said mail matter the code information corresponding to the pigeonhole location from which said mail matter was removed, sensing a pigeonhole location on the sorting cabinet with said sensing means, removing the mail matter from said pigeonhole, and encoding on said mail matter said code information.

19. The method according to claim 14 wherein said encoding step includes using said indicia means of said displayed secondary set to provide data input to a integrated circuit device, said device being responsive to said data input and operable to activate encoding means whereby a portion of said indicia means is encoded onto mail matter removed from said pigeonhole in registry with said indicia means.

* * * * *